US006503111B2

(12) United States Patent
Hirasawa

(10) Patent No.: US 6,503,111 B2
(45) Date of Patent: Jan. 7, 2003

(54) LUBRICANT FILTER MOUNTING STRUCTURE

(75) Inventor: Takeshi Hirasawa, Shizuoka (JP)

(73) Assignee: Sanshin Kogyo Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/900,705

(22) Filed: Jul. 6, 2001

(65) Prior Publication Data

US 2002/0037676 A1 Mar. 28, 2002

(30) Foreign Application Priority Data

Jul. 6, 2000 (JP) ..... 2000-205617

(51) Int. Cl.[7] ..... B63H 21/10
(52) U.S. Cl. ..... 440/88
(58) Field of Search ..... 184/1.5; 440/88, 440/89

(56) References Cited

U.S. PATENT DOCUMENTS 4,584,975 A 4/1986 Ohmi et al.
5,340,344 A 8/1994 Mineo et al.
5,655,624 A * 8/1997 Kelly ..... 184/1.5
5,769,038 A 6/1998 Takahashi et al.
5,899,779 A 5/1999 Hattori
5,957,072 A 9/1999 Hattori
5,984,742 A 11/1999 Kimura et al.
6,000,371 A 12/1999 Henmi
6,263,851 B1 7/2001 Henmi
6,273,047 B1 8/2001 Yoshikawa et al.

* cited by examiner

*Primary Examiner*—Ed Swinehart
(74) *Attorney, Agent, or Firm*—Knobbe, Martens, Olson & Bear LLP

(57) ABSTRACT

A lubricant filter mounting structure for a internal combustion engine includes a lubricant filter mounting surface and a catch member. The lubricant filter mounting surface is positioned at an angle with respect to a vertical plane, and the catch member is mounted at least partially directly below a lubricant filter. At least a portion of the induction system and at least a portion of the exhaust system is removeably mounted to the engine to enhance access to the filter, especially within the confined engine compartment of a personal watercraft.

23 Claims, 6 Drawing Sheets

LUBRICANT FILTER MOUNTING STRUCTURE

PRIORITY INFORMATION

This invention is based on and claims priority to Japanese Patent Application No. 2000-205617, filed Jul. 6, 2000.

BACKGROUND OF THE INVENTION

1. Field of the Invention

This invention relates to an engine for a watercraft, and particularly to an improved lubrication system of an engine for a watercraft.

2. Description of the Related Art

Personal watercraft had become popular in recent years. This type of watercraft is quite sporting in nature and carries a rider and possibly one, two, or three passengers. A relatively small hull of the personal watercraft commonly defines a rider's area above an engine component. An internal combustion engine frequently powers a jet propulsion unit which propels the watercraft. The engine lies within the engine compartment in front of a tunnel formed on the underside of the watercraft hull. The jet propulsion is located within the tunnel and is driven by a driveshaft. The driveshaft usually extends between the engine and the jet propulsion device, through a wall of the hull tunnel.

The rider's area usually includes an elongated seat that extends along a longitudinal center line of the watercraft. The seat has a bench-like shape that the rider and passengers can straddle. Footwells extend along side the seat. The rider and passengers straddle the seat in a tandem fashion with a rider's and passengers' legs positioned on the side of the seat and their feet placed within the foot areas.

Generally, the width of the seat not only provides an ample surface upon which the rider and passengers sit, but also provide space in which to locate an upper portion of the engine, including the engine's exhaust, induction, and lubrication systems. U.S. Pat. No. 6,155,896 illustrates an exemplary engine arrangement beneath the seat with the overall width of the seat generally matching the overall width of the engine. The cylinder head, cylinder block, exhaust manifold, exhaust expansion chamber, carburetors, and air intake are all located between the sidewalls of the seat and beneath the upper cushion of the seat.

While the position of the rider—with his or her feet positioned wide apart and his or her legs straddling the seat—provides good stability, this stance reduces the ability of the rider to absorb with his or her legs impact forces as the watercraft bounds over wakes. In addition, some small riders with less height find it uncomfortable to sit in a position with their feet widely spaced apart when straddling the seat.

Additionally, two-cycle engines commonly power personal watercraft, as these engines have the advantage of being fairly powerful and relatively light and compact. One particular disadvantage of a two-cycle engine though, is emissions content. Two-cycle engines exhaust large quantities of carbon monoxide and various hydrocarbons. However, when steps are taken to reduce the emissions content of a two-cycle engine, other generally undesirable consequences result, such as an increase in the weight of the engine, cost of manufacture, and reduction of power output.

Thus, four-cycle engines have now been proposed as the power plant for personal watercraft. These engines have the advantage of less hydrocarbon emissions than a two-cycle engine while maintaining a relatively high power output. It is therefore desirable to provide a small watercraft with a four-cycle engine in order to reduce the exhaust emissions without significantly impacting the power output of the engine that powers the watercraft.

While four-cycle engines provide great advantages over two-cycle engines, four-cycle engines are generally more complicated and tend to be larger than two-cycle engines. Thus, the space below the seat and between the sidewalls of the personal watercraft in which the upper portion of the engine is located becomes very crowded. This makes inspection and maintenance of components located toward the lower end of the engine difficult.

SUMMARY OF THE INVENTION

One aspect of the present invention involves a watercraft comprising a hull defining an engine compartment, a propulsion device, and a four-cycle internal combustion engine driving the propulsion device. The engine comprises a crankcase member, a crankshaft journaled in the crankcase member, a lubricant filter, a lubricant filter mounting surface, and a catch member. At least a portion of the catch member is located at an elevation below the lubricant filter to collect lubricant dripping out of the filter, the crankcase member or an interface between the filter and the crankcase member. The engine is disposed within the engine compartment such that the lubricant filter is located in a lower section of the engine compartment.

In accordance with another aspect of the present invention, a watercraft comprises a hull defining an engine compartment accessible through an access opening, an internal combustion engine disposed within the engine compartment, and a propulsion device driven by the engine. The engine comprises a crankcase member having a filter mounting surface, a removeably mounted exhaust pipe, a removeably mounted intake box, and a lubrication system having a filter. The filter is mounted to the crankcase member such that when the exhaust pipe and intake box are removed the filter can be accessed through the access opening.

An additional aspect of the present invention involves a watercraft comprising a hull defining an engine compartment accessible through an access opening, an internal combustion engine disposed within the engine compartment, and a propulsion device driven by the engine. The engine comprises a crankcase member having a filter mounting surface, a removeably mountable exhaust pipe, a removeably mountable intake box having an upper portion and a lower portion, and a lubrication system having a filter. The filter is mounted to the crankcase member such that when any of the exhaust pipe, the upper portion of the intake box, or the lower portion of the intake box are removed the filter can be more easily accessed through the access opening.

Another aspect of the present invention involves a method of accessing an oil filter of a four-cycle internal combustion engine of a personal watercraft. The watercraft comprises a hull defining an engine compartment, an access opening to the engine compartment, and a propulsion device. The engine drives the propulsion device. The engine comprises a crankcase member, a crankshaft journaled in the crankcase member, a lubricant filter, a lubricant filter mounting surface, an upper portion of an intake box, a lower portion of the intake box, and an exhaust system. The method also comprises removing any of the upper portion of the intake box, the lower portion of the intake box, and a portion of the exhaust system to increase the clearance between the engine and the access opening.

A further aspect of the present invention involves a watercraft comprising a hull defining an engine compartment, an access opening to the engine compartment, a propulsion device, and a four-cycle internal combustion engine driving the propulsion device. The engine comprises a crankcase member, a crankshaft journaled in the crankcase member, a lubricant filter, a lubricant filter mounting surface, an intake box, and an exhaust system. The lubricant filter extends laterally further from a center plane of the watercraft than a vertical plane including the lateral-most point of the exhaust system and the intake box.

Further aspects, features and advantages of the present invention will become apparent from the following description of the preferred embodiment.

BRIEF DESCRIPTION OF THE DRAWINGS

The above-mentioned and other features will now be described with reference to the drawings of the preferred embodiment of a marine engine including an accessible lubricant filter mounting structure in the context of a personal watercraft. The illustrated embodiment is intended to illustrate the accessible lubricant filter mounting structure, but not to limit the claims.

FIG. 6(*a*) illustrates the lubricant filter mounted to the lubricant filter mounting surface beneath the section of the exhaust system. FIG. 6(*b*) illustrates the mounting of the lubricant filter to the lubricant filter mounting surface in more detail.

DETAILED DESCRIPTION OF THE PREFERRED EMBODIMENT

With reference to the drawings and initially to FIG. 1, an overall configuration of a personal watercraft 30 will be described.

The watercraft 30 employs an internal combustion engine 32 configured in accordance with the preferred embodiment. The described engine configuration has particular utility with the personal watercraft, and thus, is described in the context of the personal watercraft. The engine configuration, however, can be applied to other types of watercrafts as well, such as, for example, small jet boats.

Figure 3:
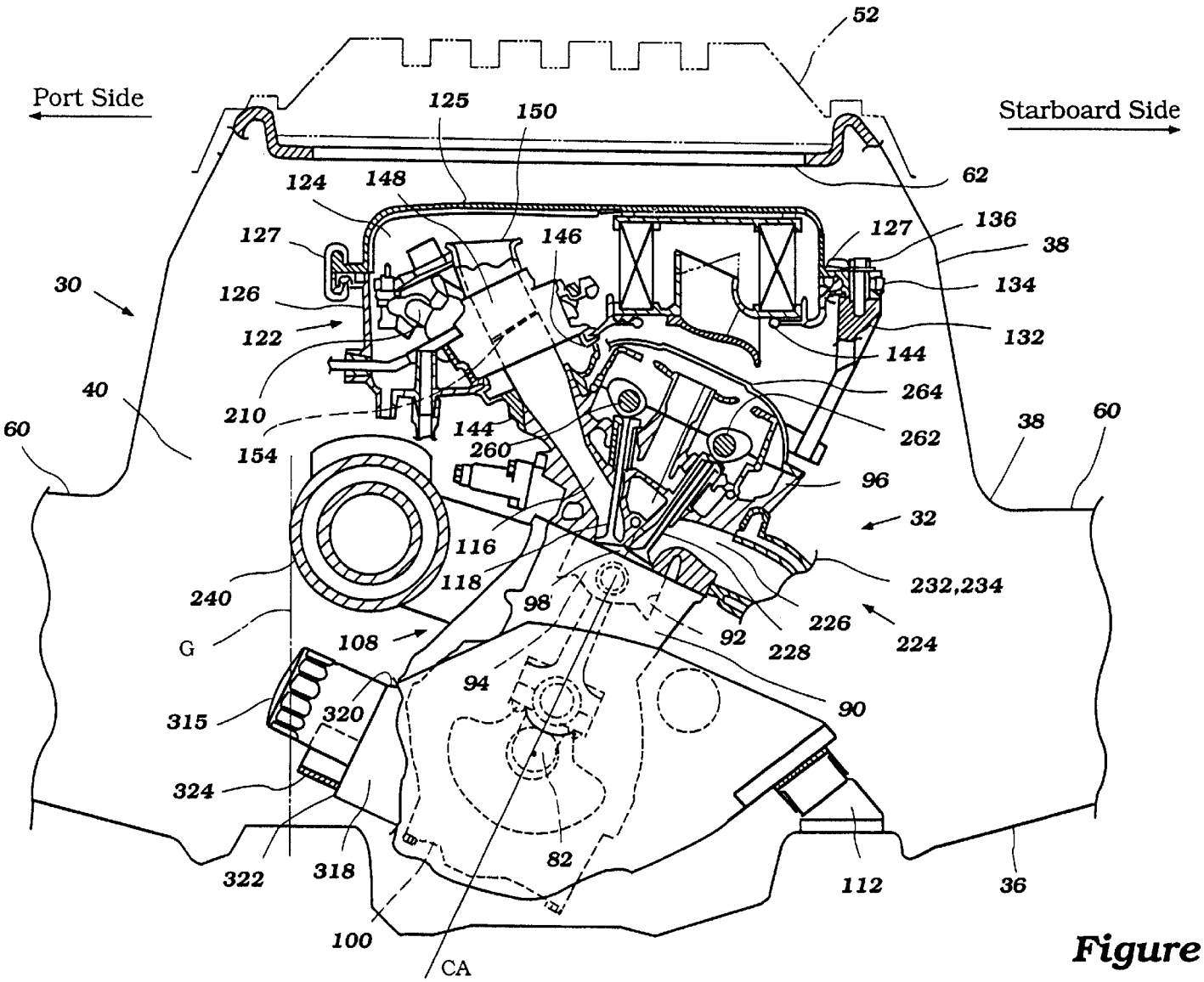
FIG. 3 is a schematic, partial-sectional rear view of the engine of FIG. 1. A profile of the hull of the watercraft is shown schematically. The engine and an opening of an engine compartment of the hull are illustrated partially in section.

The personal watercraft 30 includes a hull 34 formed with a lower hull section 36 and an upper hull section or deck 38. Both the hull sections 36, 38 are made of, for example, a molded fiberglass reinforced resin or a sheet molding compound. The lower hull section 36 and the upper hull section 38 are coupled together to define an internal cavity 40 (FIG. 3). A gunnel 42 defines an intersection of both hull sections 36, 38.

Figure 2:
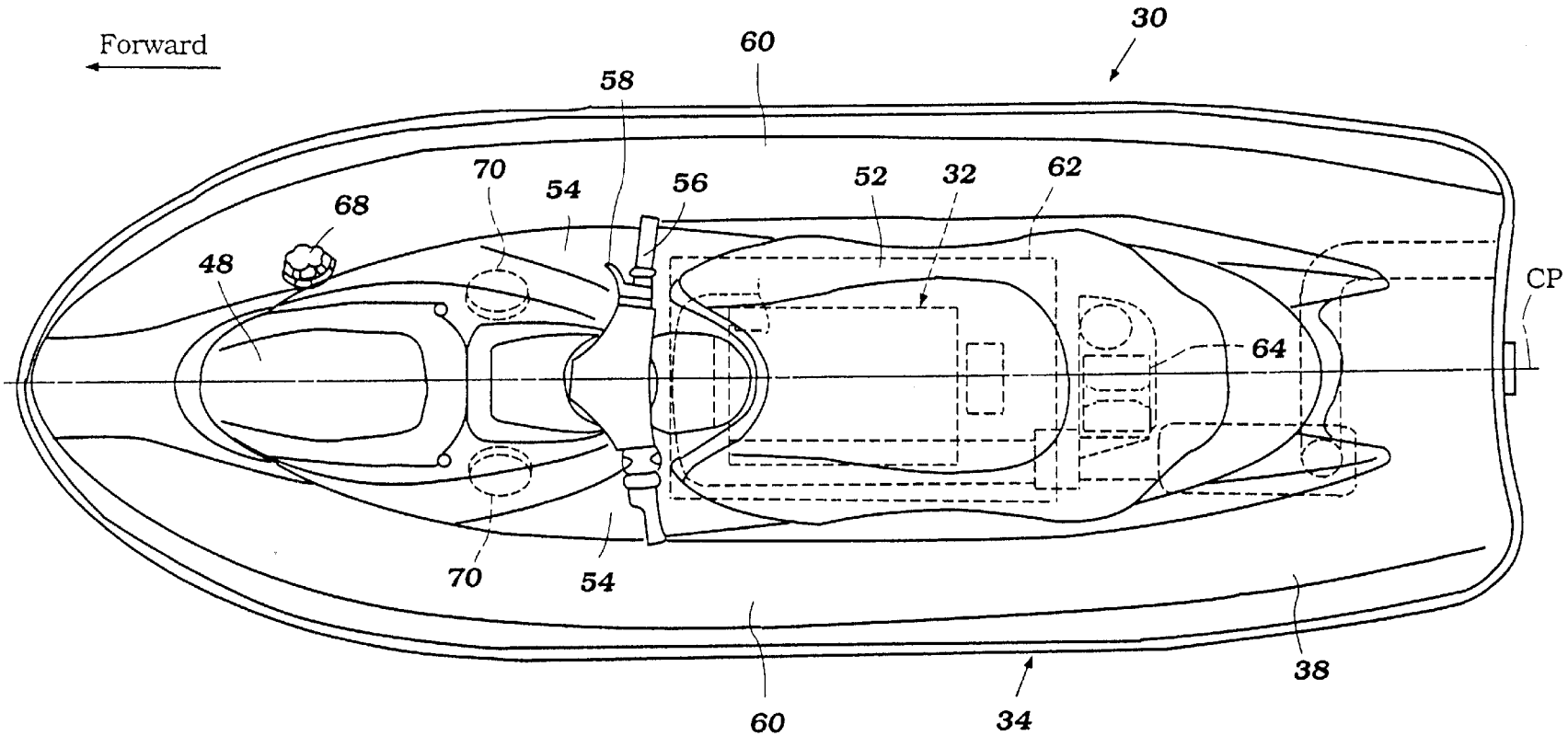
FIG. 2 is a top plan view of the watercraft.

With reference to FIGS. 2 and 3, the hull 34 defines a center plane CP that extends generally vertically from bow to stern. The upper hull section 34 includes a hatch cover 48, a control mast 50 and a seat 52 arranged from fore to aft along the center plane CP.

In the illustrated embodiment, a bow portion 54 of the upper hull section 38 slopes upwardly and an opening is provided through which the rider can access the internal cavity 40. The bow portion 54 preferably is provided with a pair of cover member pieces that are apart from one another along the center plane CP. The hatch cover 48 is detachably affixed (e.g., hinge) to the bow portion 54 so as to cover the opening. The control mast 50 extends upwardly to support a handlebar 56. The handlebar 56 is provided primarily for controlling the direction in which the water jet propels the watercraft 30. Grips are formed at both ends of the handlebar 56 so that the rider can hold them for that purpose. The handlebar 56 also carries other control units such as a throttle lever 58 that is used for control of the running conditions of the engine 32.

The seat 52 extends along the center plane CP to the rear of the bow portion 54. The seat 52 also generally defines the rider's area. The seat 52 has a saddle shape and hence a rider can sit on the seat 52 in a straddle-type fashion. A plurality of foot areas 60 are defined on both sides of the seat 52 and at the top surface of the upper hull section 38. The foot areas 60 are formed generally flat. A cushion supported by the upper hull section 38, at least in principle part, forms the seat 52. The seat 52 is detachably attached to the upper hull section 38. An access opening 62 is defined under the seat 52 through which the rider can also access the internal cavity 40. That is, the seat 52 usually closes the access opening 62. In the illustrated embodiment, the upper hull section 38 also defines a storage box 64 under the seat 52.

A fuel tank 66 is disposed in the cavity 40 under the bow portion 54 of the upper hull section 38. The fuel tank 66 is coupled with a fuel inlet port positioned at a top surface of the upper hull section 38 through a duct. A closure cap 68 closes the fuel inlet port. The opening disposed under the hatch cover 48 is available for accessing the fuel tank 66.

The engine 32 is disposed in an engine compartment defined in the cavity 40. The engine compartment preferably is located under the seat 52, but other locations are also possible (e.g., beneath the control mast or in the bow.) The rider thus can access the engine 32 in the illustrated embodiment through the access opening 62 by detaching the seat 52.

A plurality of air ducts or ventilation ducts 70 are provided on both sides of the bow portion 54 so that the ambient air can enter the internal cavity 40 therethrough. Except for the air ducts 70, the engine compartment is substantially sealed so as to protect the engine 32 and other components from water.

A jet pump unit 72 propels the watercraft 30. The jet pump unit 72 includes a tunnel 74 formed on the underside of the lower hull section 36 which is isolated from the engine compartment by a bulkhead. The tunnel 74 has a downward facing inlet port 76 opening toward the body of water. A jet pump housing 78 is disposed within a portion of the tunnel 74 and communicates with the inlet portion 76. An impeller (not shown) is supported within the housing 78.

An impeller shaft 80 extends forwardly from the impeller and is coupled with a crankshaft 82 of the engine 32 by a coupling member 84. The crankshaft 82 of the engine 32 thus drives the impeller shaft 80. The rear end of the housing 78 defines a discharge nozzle 85 and a steering nozzle 86 is affixed to the discharge nozzle 85 for pivotal movement about a steering axis extending generally vertically. The steering nozzle 86 is connected to the handlebar 56 by a cable so the rider can pivot the nozzle 86.

As the engine 32 drives the impeller shaft 80 and hence rotates the impeller, water is drawn from the surrounding body of water through the inlet port 76. The pressure generated in the housing 78 by the impeller produces a jet of water that is just discharged through the steering nozzle 86. This water jet propels the watercraft 30. The rider can move the steering nozzle 86 with the handlebar 56 when he or she desires to turn the watercraft 80 in either direction.

The engine 32 operates on a four-stroke cycle combustion principle. With reference to FIG. 3, the engine 32 includes a cylinder block 90. The cylinder block 90 defines four cylinder bores 92 spaced from each other from fore to aft along a cylinder center plane CCP. The engine 32 thus is a L4 (in-line four cylinder) type. The illustrated engine, however, merely exemplifies one type of engine on which various aspects and features described herein can be used. Engine having other numbers of the cylinders, having other cylinder arrangements, other cylinder orientations (e.g., upright cylinder banks, V-type, W10 type) and operating on other combustion principles (e.g., crankcase compression two-stroke, diesel, and rotary) are all practicable.

Each of the cylinder bores 92 has a center axis CA that is slanted or inclined at an angle from the center plane CP so that the engine 32 can be shorter in height. All the center axes in the illustrated embodiment are inclined at the same angle and lie in the cylinder center plane CCP. The pistons 94 reciprocate within the cylinder bores 92. A cylinder head 96 is affixed to the upper end of the cylinder block 90 to close respective upper ends of the cylinder bores 92 and defines four combustion chambers 98 with the cylinder bores 92 and the pistons 94.

The cylinder block 90, the cylinder head 96, and a crankcase member 100 together 20 define an engine body 108. The engine body 108 preferably is made of an aluminum based alloy. In the illustrated embodiment, the engine body 108 is oriented in the engine compartment so as to position the crankshaft 82 in the center plane CP and to extend generally in the longitudinal direction. Other orientations of the engine body, of course, are also possible (e.g., with a transverse or vertical oriented crankshaft).

A plurality of engine mounts 112 extend from both sides of the engine body 108. The engine mounts 112 preferably include resilient portions made of, for example, a rubber material. The engine 32 preferably is mounted on the lower hull section 36, specifically, a hull liner, by the engine mounts 112 so that vibration of the engine 32 is inhibited from conducting to the hull section 36.

The engine 32 preferably includes an air induction system to introduce air to the combustion chambers 98. In the illustrated embodiment, the air induction system includes four intake passages 116 defined in the cylinder head 96. The intake passages 116 communicate with the associated combustion chamber 98 through one or more respective intake ports. A plurality of intake valves 118 are provided to selectively connect and disconnect the intake passages 116 with the combustion chambers 98. That is, the intake valves 118 selectively open and close the intake ports.

The air induction system also includes an air intake box 122 or a "plenum chamber" for a smoothing intake air and acting as an intake silencer. The intake box 122 in the illustrated embodiment is generally configured as a rectangular chamber and the width of the intake box 122 is approximately equal to the width of the access opening 62. The intake box 122 defines a plenum chamber 124. The intake box 122 further comprises an upper portion 125 and a lower portion 126. The portions 125, 126 are detachably coupled using any suitable coupling, for example, slide clamps 127. Other shapes of the intake box of course are possible, but it is desired to make the plenum chamber as large as possible within the space provided in the engine compartment. In the illustrated embodiment, a space is defined between the top of the engine 32 and the bottom of the seat 52 due to the inclined orientation of the engine. A rectangular shape of at least a principle portion of the intake box 122 conforms to this space.

With reference to FIG. 3, the intake box 122 preferably is coupled to the engine body 108. In the illustrated embodiment, while a plurality of stays 132 extend upwardly from the engine body 108, a flange portion 134 of the lower portion 126 of the intake box 122 extends generally horizontally. A plurality of fastening members, e.g., bolts 136, rigidly affix the flange portion 134 of the lower portion 126 of the intake box 122 to respective top surfaces of the stays 132 (see FIG. 5). The intake box 122 thus is laid in a space defined between the engine body 108 and the seat 52, i.e., the rider's area of the hull 34, so that the plenum chamber 124 defines a relatively large volume therein.

With reference to FIG. 3, the intake box 122 defines an inlet opening 144 and four outlet apertures 146. Four throttle bodies 148 extend through the apertures 146 and preferably are fixed to the lower side of the intake box 122. Respective bottom ends of a plurality of throttle bodies 148 are coupled with the associated intake passages 116 with fasteners, such as hose clamps 149. Preferably, as illustrated in FIG. 3, the position at which the apertures 146 are sealed to the throttle bodies 148 are spaced from the outlet of the "bottom" ends of the throttle bodies 148. Thus, the intake box 122 is spaced from the engine 32, thereby attenuating transfer of heat from the engine body 108 into the intake box 122.

With reference to FIG. 3, the throttle bodies 148 slant toward the port side oppositely the center plane CP of the engine body 108. Respective top ends of the throttle bodies 148 open upwardly within the plenum chamber 124 to form an induction air inlet 150. Air in the plenum chamber 124 thus is drawn into the combustion chamber 98 through the throttle bodies 148 and the intake passages 116 when negative pressure is generated in the combustion chamber 98. The negative pressure is generated when the pistons 94 move toward the bottom dead center from the top dead center.

As illustrated in FIG. 3, each of the throttle bodies 148 include a throttle valve 154. Pivotal movement of the throttle valve 154 is controlled by the throttle lever 58 on the handlebar 56 through a control cable that is connected to a throttle valve shaft (not shown). The rider thus can control opening amount of the throttle valves 154 by operating the throttle lever 58 so as to obtain various running conditions of the engine 32 that the rider desires. That is, an amount of air passing through the throttle bodies 148 is controlled by this mechanism and delivered to the respective combustion chambers 98.

Figure 1:
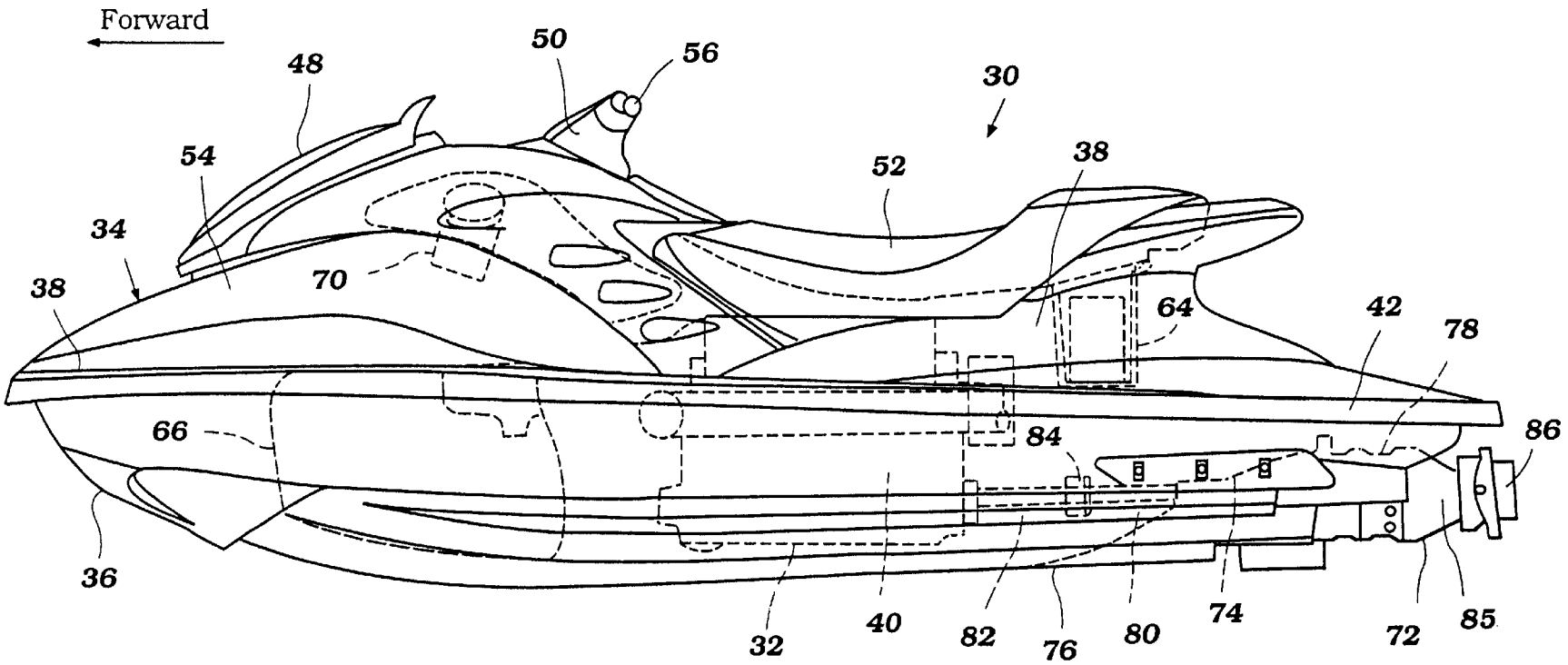
FIG. 1 is a side elevational view of a personal watercraft of the type powered by an engine. Several of the internal components of the watercraft (e.g., the engine) are illustrated in phantom.

The engine 32 also includes a fuel supply system as illustrated in FIGS. 1 and 3. The fuel supply system includes the fuel tank 66 and the fuel injectors 210 that are affixed to a rail (not shown) and are mounted to the throttle bodies 148. Because the throttle bodies 148 are disposed within the plenum chamber 124, the fuel injectors 210 are also desirably positioned within the plenum chamber 124. However, other types of fuel injectors can be used which are not mounted in the plenum chamber 124, such as, for example, but without limitation, direct fuel injectors and induction passage fuel injectors connected to the scavenge passages of the two-cycle engines. The fuel injectors 210 spray the fuel into the intake passages 116 toward the intake ports at an injection timing and duration under control of an electronic control unit (ECU). The ECU can control the injection timing and duration according to any known control strategy which preferably refers to a signal from at least one engine sensor, such as, for example, but without limitation, a throttle valve position sensor.

The sprayed fuel is delivered to the combustion chambers 98 with the air, the intake ports are opened to the combustion chambers 98 by the intake valves 118. The air and the fuel are mixed together to form air/fuel charges which are then combusted in the combustion chamber 98.

The engine 32 further includes an exhaust system 224 to discharge burnt charges, i.e., exhaust gases, from the combustion chambers 98. In the illustrated embodiment, with reference to FIG. 3, the exhaust system 224 includes four exhaust passages 226. The exhaust passages 226 are defined in the cylinder head 96 and communicate with the associated combustion chambers 98 through one or more respective exhaust ports. A plurality of exhaust valves 228 are provided to selectively connect and disconnect the exhaust ports with the combination chambers 98. That is, the exhaust valves selectively open and close the exhaust ports.

Figure 4:
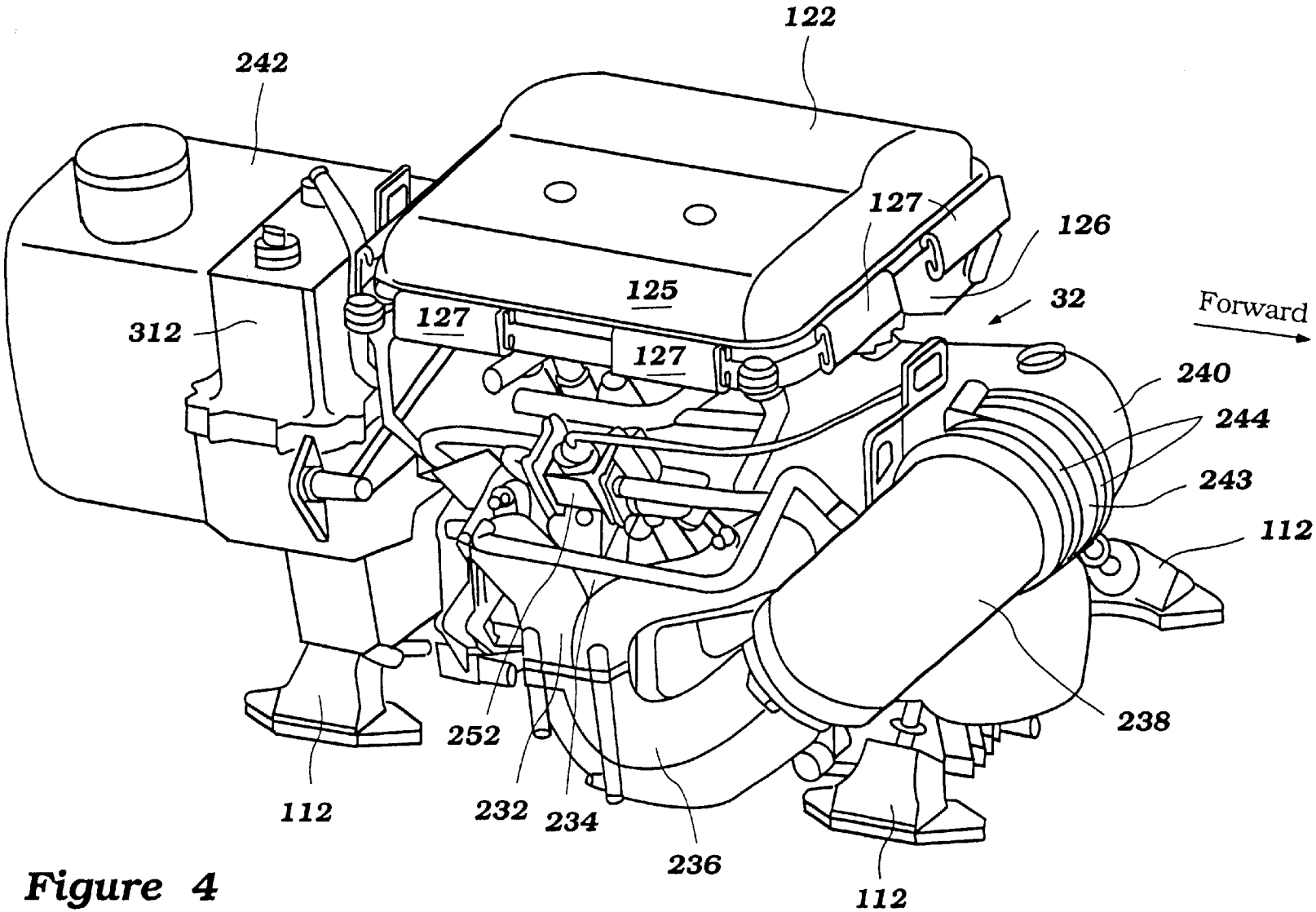
FIG. 4 is a perspective view of the engine viewed from a slightly forward location on the starboard side and isolated from the hull.

As illustrated in FIG. 4, the exhaust system includes an exhaust manifold 231. In the presently preferred embodiment, the exhaust manifold 231 comprises a first exhaust manifold 232 and a second exhaust manifold 234 coupled with the exhaust passages 226 on the starboard side to receive exhaust gases from the respective passages 226. The first exhaust manifold 232 is connected with two of the exhaust passages 226 and the second exhaust manifold 234 is connected with the other two exhaust passages 226. In a presently preferred embodiment, the first and second exhaust manifolds 232, 234 are configured to nest with each other.

Respective downstream ends to the first and second manifolds 232, 234 are coupled to a first unitary exhaust conduit 236. As seen, for example in FIG. 4, the first unitary conduit 236 is further coupled with a secondary unitary conduit 238. The secondary unitary conduit 238 is then coupled with an exhaust pipe 240 on the rear side of the engine body 108.

The exhaust pipe 240 extends forwardly along a side surface of the engine body 108 on the port side. The exhaust pipe 240 is connected to the side surface of the engine body 108 by one or more bolts 241. The exhaust pipe 240 is then connected to a water-lock 242 at a forward surface of the water-lock 242. The exhaust conduits 238, 234 can be coupled using a hose 243 and one or more clamps 244. Likewise, a hose 245 and one or more clamps 246 can be used at a junction between the exhaust pipe 240 and the water-lock 242.

With reference to FIG. 4, the engine 32 preferably includes a secondary air supply system that supplies air from the air induction system to the exhaust system 224. More specifically, for example, hydrocarbon (HC) and carbon monoxide (CO) components of the exhaust gases can be removed by an oxidation reaction with oxygen ($O_2$) that is supplied to the exhaust system 224 from the air induction system.

With reference to FIG. 4, a secondary air supply device 252 is disposed next to the cylinder head 96. The air supply device 252 defines a closed cavity therein and contains a control valve. The air supply device 252 is affixed to the engine body 108 together with one of the stays 132 that support the air intake box 122.

With reference to FIG. 3, the engine 32 has a valve cam mechanism for actuating the intake and the exhaust valves 118, 228. In the illustrated embodiment, a double overhead cam drive is employed. That is, an intake cam shaft 260 actuates the intake valve 118 and an exhaust cam shaft 262 separately actuates the exhaust valves 228. The intake cam shaft 260 extends generally horizontally over the intake valves 118 from fore to aft in parallel to the center plane CP, and the exhaust cam shaft 262 extends generally horizontally over the exhaust valves 228 from fore to aft also in parallel to the center plane CP.

Both the intake and the exhaust cam shafts 260, 262 are journaled to the cylinder head 96 with a plurality of cam shaft caps. The cam shaft caps holding the cam shafts 260, 262 are fixed to the cylinder head 96. A cylinder head cover member 264 extends over the cam shaft 260, 262 and the cam shaft caps and is affixed to the cylinder head 96 to define a cam shaft chamber. The stays 132 and the secondary air supply device 252 are preferably affixed to a cylinder head cover member 264. Additionally, the air supply device 252 is desirably disposed between the intake air ducts and the engine body 108. The intake cam shaft 260 has cam lobes each associated with a respective intake valve 118, and the exhaust cam shaft 262 also has cam lobes associated with the respective exhaust valves 228. The intake and exhaust valves 118, 228 normally close the intake and the exhaust ports by a biasing force of one or more springs. When the intake and the exhaust cam shafts 260, 262 rotate, the cam lobes push the respective valves 118, 228 to open the respective ports by overcoming the biasing force of the spring(s). The air thus can enter the combustion chamber 98 when the intake valves 118 are open. In the same manner, the exhaust gases can move out from the combustion chambers 98 when the exhaust valves 228 are open.

The crankshaft 82 preferably drives the intake and the exhaust cam shafts 260, 262. The respective cam shafts 260, 262 have driven sprockets affixed to the ends thereof. The crankshaft 82 has a drive sprocket. Each driven sprocket has a diameter that is twice as large as the diameter of a drive sprocket. The timing chain or belt is wound around the drive and driven sprockets. When the crankshaft 82 rotates, the drive sprocket drives the driven sprockets via a timing chain, and thus, the intake and the exhaust cam shafts 260, 262 also rotate. The rotational speed of the cam shafts 260, 262 is reduced to half as the rotational speed of the crankshaft 82 because of the differences in the diameter of the drive and driven sprockets.

Ambient air enters the internal cavity 40 defined in the hull 34 through the air duct 70. The air is then introduced into the plenum chamber 124 defined by the intake box 122 and drawn into the throttle bodies 148. An air filter (not shown) filters the air before the air enters the throttle bodies. The majority of the air in the plenum chamber 124 is supplied to the combustion chamber 98. The throttle valves 154 and the throttle bodies 148 regulate an amount of the air permitted to pass to the combustion chamber 98. The opening angles of the throttle valves 154 are controlled by the rider with the throttle lever 58 and thus controls the air flow access to the valves. The air hence flows into the combustion chambers 98 when the intake valves 118 open. At the same time, the fuel injectors 210 spray fuel into the intake passages 116 toward the intake ports under control of the ECU. Air/fuel charges are thus formed and delivered to the combustion chambers 98.

The air/fuel charges are fired by spark plugs under the control of the ECU. The burnt charges, i.e., exhaust gases, are discharged to the body of the water surrounding the watercraft 30 through the exhaust system 224. A relatively small amount of the air in the plenum chamber 124 is supplied to the exhaust system 224 through the secondary air supply system so as to aid in further combustion of any unburned fuel remaining in the exhaust gases.

The combustion of the air/fuel charges causes the pistons 94 to reciprocate and thus causes the crankshaft 82 to rotate. The crankshaft 82 drives the impeller shaft 80 and the impeller shaft rotates the hull tunnel 74. Water is thus drawn into the tunnel 74 through the inlet port 76 and then is discharged rearward through the steering nozzle 86. The rider steers the nozzle 86 by the steering handlebar 56. The watercraft 30 thus moves as the rider desires.

Figure 5:
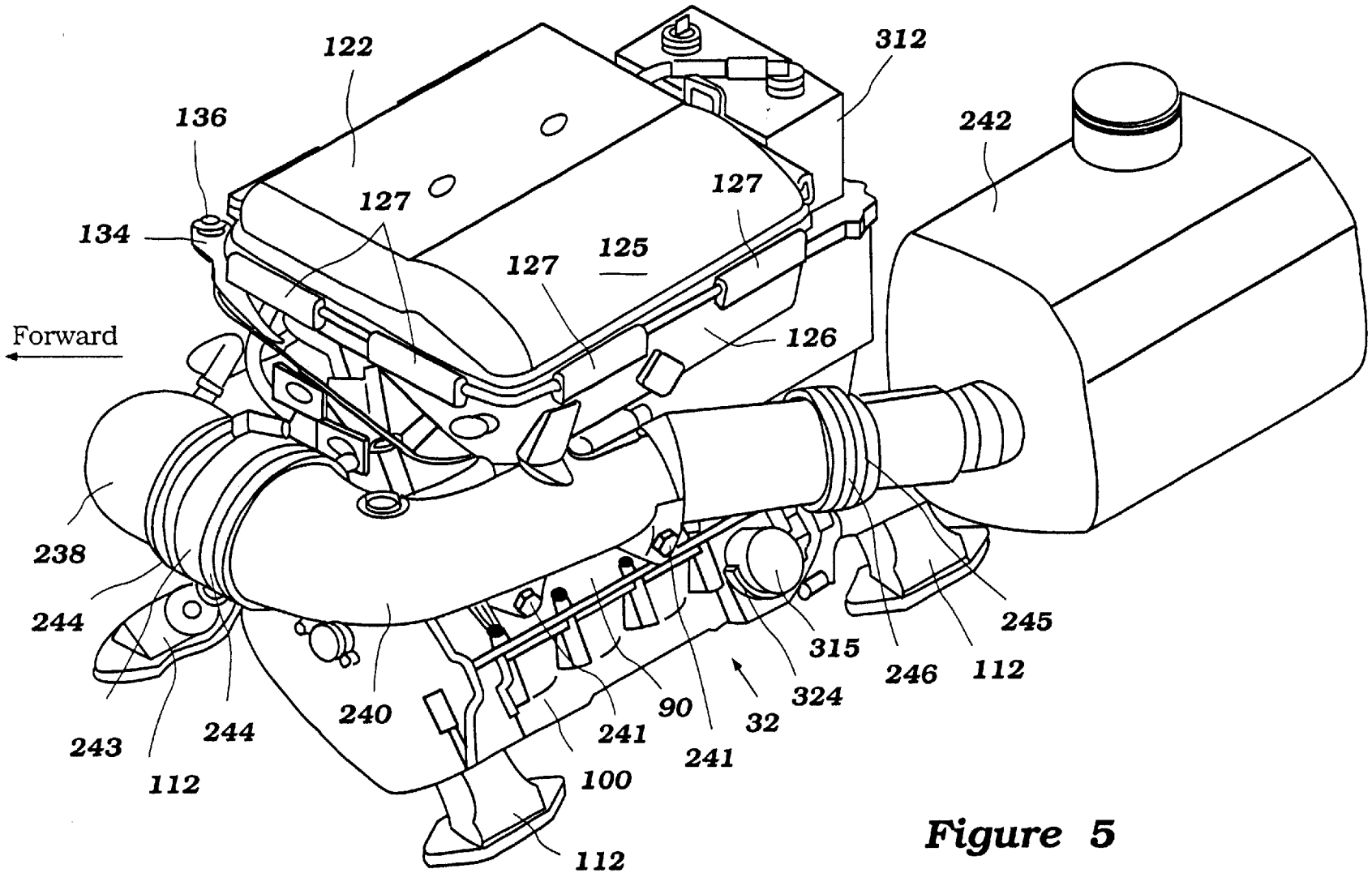
FIG. 5 is a perspective view of the engine viewed from a slightly forward location on the port side and isolated from the hull.
Figure 6A:
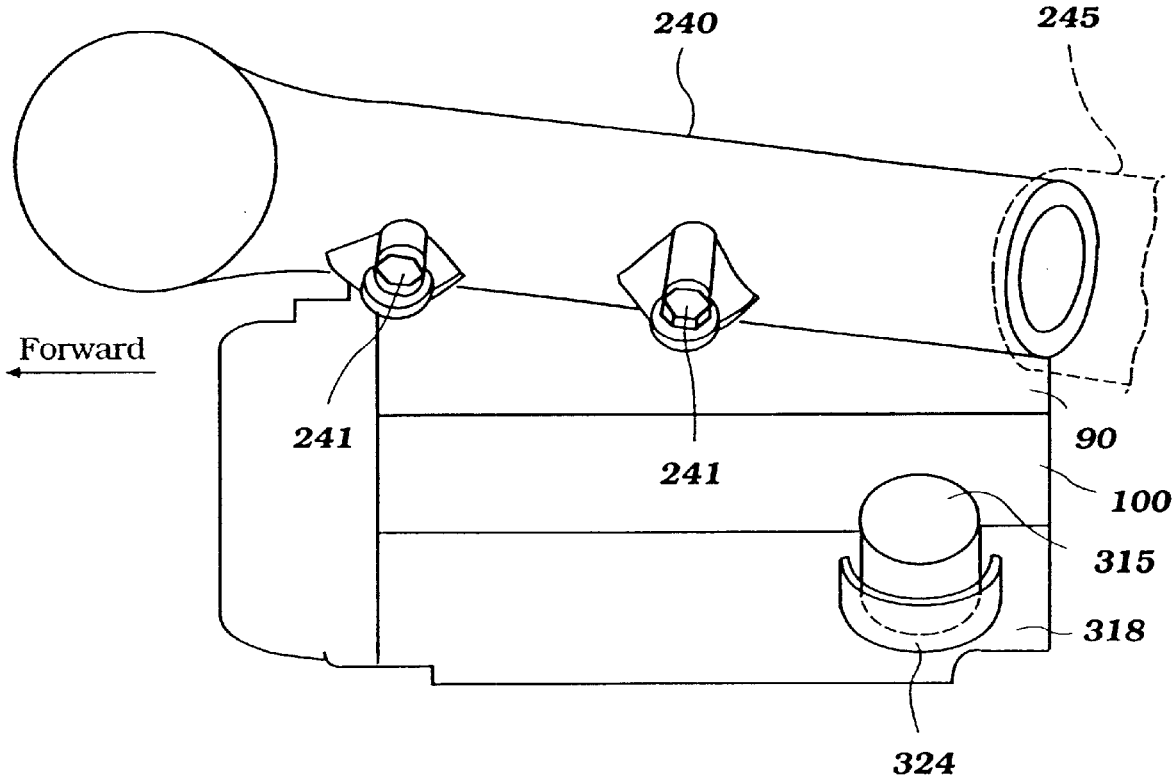
FIG. 6 is a schematic two-view drawing showing a lubricant filter mounting and an adjacent section of an exhaust system.
Figure 6B:
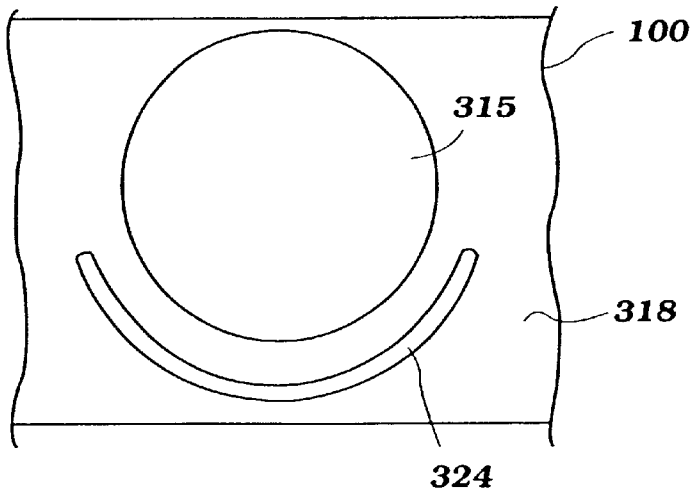

The engine 32 preferably includes a lubrication system that delivers lubricant to a plurality engine components to reduce wear of the components. In the illustrated embodiment, a dry-sump lubrication system is employed. This system is a closed-loop type and includes a lubricant reservoir 312 as illustrated in FIGS. 4 and 5.

A lubricant delivery pump is provided within a circulation loop to deliver the lubricant in the reservoir 312 to the engine components that are to be lubricated, for example, but without limitation, the pistons 94 and crankshaft bearings (not shown). The delivery pump preferably is driven by the crankshaft 82 or one of the cam shafts 260, 262. The lubricant passes through a lubricant filter 315, which is located upstream from the components to be lubricated, and which removes foreign substances from the lubricant.

The lubricant filter 315 is located on a lubricant filter mounting surface 318 that is located on the port side of the engine body 108 of the watercraft 30. The mounting surface may be formed as a part of the crankcase member 100, e.g. a part of the crankcase member's outer surface. As mentioned above, the engine cylinder bores 92 are formed at an angle with respect to the central plane CP of the engine, thus the cylinder bores 92 lean to one side relative to a vertical plane that includes the crankshaft 82. The lubricant filter mounting surface 318, and thus the lubricant filter 315 when mounted, are located on the opposite side of the center plane CP from the cylinder bores 92.

In addition to being on the opposite side of the center plane CP from the cylinder bores 92, the lubricant filter mounting surface 318 is formed at an angle with respect to the center plane CP. This angle causes the mounting surface upper end 320 to be closer that the mounting surface lower end to the center plane CP. As a result, the lubricant that escapes at the juncture of the filter 315 and the lubricant filter mounting surface 318 will flow downwardly and outwardly from the center plane CP.

With reference to FIG. 3, a vertical plane G is shown extending tangentially to the outside of the exhaust pipe 240. More generally, the plane G is a vertical plane including the farthest lateral point of the exhaust pipe 240 and the intake box 122 from the center plane CP. As may be seen in FIG. 3, the oil filter 315 and the oil filter mounting surface 318 are configured so that the farthest point laterally of the filter 315 from the center plane CP is farther from the center plane CP than is the plane G.

A catch member 324 having a semi-circular shape is located on the lubricant filter mounting surface 318 of the crankcase member 100. The catch member 324 is mounted generally below the lubricant filter 315 and partially concentrically around the lubricant filter 315. The catch member 324 and the mounting surface 318 can be formed of a unitary construction, or can be attached in another manner. The catch member 324, being located generally beneath the lubricant filter 315 is positioned to collect any lubricant that drips or otherwise escape from the crankcase member 100, lubricant filter 315, or the junction between the member 100 and filter 315.

The lubricant filter 315 is accessible for maintenance through the access opening 62. The engine 32 is tightly confined within the internal cavity 40, and as mentioned above, the width of the intake box 122 is approximately equal to the width of the access opening 62. Consequently, accessing the filter for inspection and maintenance can be extremely difficult.

Access to the filter 315 can be improved by making at least a portion of one or more of the intake box 122 and the exhaust system removable. For example, the upper portion 125 of the intake box 122 can be removed by removing the slide clamps 127. This increases the clearance between the access opening 62 and the lower portion 126 of the intake box 122, ad thereby improving access to the filter 315. Access to the filter 315 can be further improved by removing the lower portion 126 of the intake box 122. To remove the lower portion 126 of the intake box 122, the bolt 136 is removed. Then the hose clamps 149 are removed to separate the throttle bodies 148 from the cylinder head 96. The entire intake box 122 can then be removed to improve further access to the filter 315.

Access to the filter 315 can also further be improved by removing at least a portion of the exhaust system. For example, the exhaust pipe 240 can be removed by loosening and removing bolts 241, and by loosening one or more of clamps 244, 246. Or, the clamps 244, 246 could be left in place upon removing the bolts 241. In that case the flexibility of the hoses 243, 245 permits manipulation of the exhaust pipe 240 sufficient to improve access to the filter 315. In another variant, other exhaust system components, e.g. at least a portion of the exhaust pipe 240 between the rear-most bolt 241 and the water-lock 242, could be removed to improve access to the oil filter. Thus, removal of one or more component of the intake and/or exhaust systems improves access to the filter 315 through the access opening 62.

Thus, from the foregoing description, it should be readily apparent that the described embodiment of the accessible lubricant filter mounting structure provide a lubrication filter mounting structure that can be accessed through the access opening of a water vehicle hull and that is configured to collect lubricant that may escape from one or more of the engine and the lubricant filter. Of course, the foregoing description is that of a preferred embodiment of the accessible lubricant filter mounting structure and various changes and modifications may be made without departing from the spirit and scope of the appended claims.

What is claimed is:

1. A watercraft comprising a hull defining an engine compartment, a propulsion device, and a four-cycle internal combustion engine driving the propulsion device, the engine comprising an engine body defined in part by a crankcase member, a crankshaft journaled in the engine body, a lubricant filter, a lubricant filter mounting surface, and a catch member including a first end disposed generally next to the engine body and a second end disposed away from the engine body, at least a portion of second end located above at least a portion of the first end, at least a portion of the catch member being disposed directly below the lubricant filter, the engine being disposed within the engine compartment such that the oil filter is located in a lower section of the engine compartment.

2. The watercraft of claim 1, wherein the hull defines a longitudinal axis and the engine is oriented in the hull such that the crankshaft rotates about an axis that is lies parallel to the longitudinal axis.

3. The watercraft of claim 1, further comprising an engine center plane, the engine center plane being a vertical plane that includes an axis of the crankshaft, wherein the lubricant filter mounting surface is a planar surface that is formed at an angle with respect to the center plane.

4. The watercraft of claim 3, wherein the lubricant filter mounting surface is angled such that the portion of the lubricant filter mounting surface that is at the highest elevation is closer to the engine center plane than the rest of the lubricant filter mounting surface.

5. The watercraft of claim 1, wherein the catch member and the lubricant filter mounting surface are unitary.

6. The watercraft of claim 1, wherein the lubricant filter mounting surface is an outside surface of the crankcase member.

7. The watercraft of claim 1, wherein the engine additionally includes an exhaust system including an exhaust pipe section that extends along side the engine body in a direction generally parallel to an axis of the crankshaft, an air box disposed above the engine body, a central vertical plane that includes the axis of the crankshaft, wherein an outer vertical plane lies generally parallel to the central vertical plane and passes tangentially through an outermost point of the exhaust pipe section and the air box, and wherein the lubricant filter mounting surface is disposed on the engine body such that at least a portion of the lubricant filter lies farther from the central vertical plane than does the outer vertical plane.

8. The watercraft of claim 7, wherein at least a portion of one of the exhaust system and the air box lies above the lubricant filter and is detachably coupled from the engine body.

9. The watercraft of claim 8, wherein the exhaust pipe section is detachably connected to at least another exhaust pipe section.

10. The watercraft of claim 8, wherein at least a section of the air box is detachably connected to another section of the air box.

11. The watercraft of claim 8, wherein the air box is detachably connected to the engine body.

12. A watercraft comprising a hull defining an engine compartment accessible through an access opening, an internal combustion engine disposed within the engine compartment, a propulsion device driven by the engine, the engine including an engine body having an crankcase member, a crankshaft journaled within the engine body, the crankcase member having a filter mounting surface, an exhaust pipe section removably coupled to the engine body and disposed at least in part generally below the access opening and generally above the filter mounting surface, an air box removably coupled to the engine body and disposed at least in part generally below the access opening and generally above the filter mounting surface, and a lubrication system having a filter, the filter mounting surface being arranged such that when the exhaust pipe section and the air box are removed the filter can be accessed through the access opening.

13. The watercraft of claim 12, wherein the crankcase member further includes a catch member that is disposed at least in part directly below the filter mounting surface.

14. The watercraft of claim 12, wherein the filter mounting surface is formed at an angle with respect to a vertical plane that includes an axis of a crankshaft journaled in the crankcase member.

15. The watercraft of claim 14, wherein the filter mounting surface is angled such that the portion of the lubricant filter mounting surface that is at the highest elevation is closer to the vertical plane than the rest of the lubricant filter mounting surface.

16. An internal combustion engine comprising a crankcase member, a lubricant filter mounting surface on the crankcase member, a lubricant filter configured to be mountable to the lubricant filter mounting surface, the lubricant filter extending a first distance along a line perpendicular to the lubricant filter mounting surface when the lubricant filter is mounted to the lubricant filter mounting surface, and a catch member extending a second distance along a line perpendicular to the lubricant filter mounting surface, the second distance being less than the first distance, at least a portion of the catch member is disposed directly below the lubricant filter mounting surface.

17. The internal combustion engine of claim 16, wherein the catch member and the lubricant filter mounting surface are unitary.

18. A watercraft comprising a hull having a longitudinal axis and defining an engine compartment, an access opening to the engine compartment, a propulsion device, and a four-cycle internal combustion engine driving the propulsion device, the engine comprises a crankcase member, a crankshaft journaled in the crankcase member, a lubricant filter, a lubricant filter mounting surface, an intake box, and an exhaust system, wherein the lubricant filter extends laterally further from a center vertical plane of the watercraft, which contains the longitudinal axis, than a parallel vertical plane that including the lateral-most point of the exhaust system and the intake box.

19. A method of accessing an oil filter of a four-cycle internal combustion engine of a personal watercraft comprising:

providing the watercraft comprising a hull defining an engine compartment, an access opening to the engine compartment, a propulsion device, and the engine driving the propulsion device, the engine comprises a crankcase member, a crankshaft journaled in the crankcase member, a lubricant filter, a lubricant filter mounting surface, an upper portion of an intake box, a lower portion of the intake box, and an exhaust system;

removing the upper portion of the intake box to increase the clearance between the engine and the access opening;

removing the lower portion of the intake box to increase the clearance between the engine and the access opening; and removing a portion of the exhaust system to increase the clearance between the engine and the access opening.

20. A watercraft comprising a hull defining an engine compartment, a propulsion device, and a four-cycle internal combustion engine driving the propulsion device, the engine comprising an engine body defined in part by a crankcase member, a crankshaft journaled in the engine body, a lubricant filter, a lubricant filter mounting surface being formed at an angle with respect to a vertical central plane of the engine such that the portion of the lubricant filter mounting surface that is at the highest elevation is closer to the vertical central plane than is the rest of the lubricant filter mounting surface, and a catch member, at least a portion of the catch member being disposed directly below the lubricant filter, the engine being disposed within the engine compartment such that the oil filter is located in a lower section of the engine compartment.

21. A watercraft comprising a hull defining an engine compartment, a propulsion device, and a four-cycle internal combustion engine driving the propulsion device, the engine comprising an engine body defined in part by a crankcase member, a crankshaft journaled in the engine body, a lubricant filter, a lubricant filter mounting surface, a catch member, at least a portion of the catch member being disposed directly below the lubricant filter, an exhaust system including an exhaust pipe section that extends along side the engine body in a direction generally parallel to an axis of the crankshaft, an intake box disposed above the engine body, and a central vertical plane that includes the axis of the crankshaft, the engine being disposed within the engine compartment such that the oil filter is located in a lower section of the engine compartment, wherein an outer vertical plane lies generally parallel to the central vertical plane and passes tangentially through an outermost point of the exhaust pipe section and the intake box, and wherein the lubricant filter mounting surface is disposed on the engine body such that at least a portion of the lubricant filter lies farther from the central vertical plane than does the outer vertical plane.

22. A watercraft comprising a hull defining an engine compartment accessible through an access opening, an internal combustion engine disposed within the engine compartment, a propulsion device driven by the engine, the engine including an engine body having a filter mounting surface, an exhaust pipe section removably coupled to the engine body and disposed at least in part generally below the access opening and generally above the filter mounting surface, an intake box coupled with the engine body and disposed at least in part generally below the access opening and generally above the filter mounting surface, at least a portion of the intake box being removable, and a lubrication system having a filter generally abutting the filter mounting surface, the filter mounting surface being arranged such that when at least one of the exhaust pipe section and the portion of the intake box are removed the filter can be accessed through the access opening.

23. A watercraft comprising a hull defining an engine compartment, a propulsion device, and an engine disposed within the engine compartment and coupled to the propulsion device, the engine comprising an engine body, an output shaft journaled within the engine body so as to rotate about a rotational axis, and a lubrication system supplying lubrication to at least portions of the engine body, the lubrication system comprising a removable lubricant filter disposed within the engine compartment, and a catch member disposed generally beneath the lubricant filter, the lubricant filter extending beyond an end of the catch member.

* * * * *